US007478577B1

(12) United States Patent
Wheeler

(10) Patent No.: US 7,478,577 B1
(45) Date of Patent: Jan. 20, 2009

(54) QUICK ADJUST RATCHETING WRENCH WITH CAM ACTUATED CLAMPING

(76) Inventor: Thomas J Wheeler, 295 E. Columbia Ave., Pomona, CA (US) 91767

( * ) Notice: Subject to any disclaimer, the term of this patent is extended or adjusted under 35 U.S.C. 154(b) by 0 days.

(21) Appl. No.: 11/679,739

(22) Filed: Feb. 27, 2007

Related U.S. Application Data

(60) Provisional application No. 60/776,865, filed on Feb. 27, 2006.

(51) Int. Cl.
*B25B 13/46* (2006.01)
*B28B 13/18* (2006.01)

(52) U.S. Cl. ..... 81/63; 81/128

(58) Field of Classification Search ..... 81/60–63.2, 81/128, 129, 179
See application file for complete search history.

(56) References Cited

U.S. PATENT DOCUMENTS 168,406 A * 10/1875 Ober ..... 81/60
324,169 A * 8/1885 Rollin ..... 81/62
3,664,213 A * 5/1972 Anati ..... 81/128
4,016,782 A * 4/1977 Guimarin ..... 81/63
4,748,875 A * 6/1988 Lang ..... 81/63
5,076,121 A * 12/1991 Fosella ..... 81/63.2
5,595,095 A * 1/1997 Hillinger ..... 81/60
6,971,284 B2 * 12/2005 Owoc ..... 81/128

* cited by examiner

*Primary Examiner*—Hadi Shakeri
(74) *Attorney, Agent, or Firm*—Gary Hoenig

(57) ABSTRACT

The invention is a wrench with jaws adjusted by a cam mechanism and a ratchet mechanism providing a free return stroke of the handle, a simplified construction, convenience of use, durability, effectiveness, and cost and weight reduction; comprising a handle with housing, annular control and adjusting discs, a plurality of radial guide slots in the adjusting disc and cam features in the control disc, a plurality of jaws in the housing, each jaw, having a slider spring loaded, is positioned in said guide slots, and a cam follower interacting with cam features formed on the inner edge of the control disc; radial guide slots on the surface of the adjusting disc facing the control disc, each guide slot limited by the inner arch-shaped edge of the adjusting disc and open on its periphery; cam followers and profiles provide wedging to the rotation of the discs during the return stroke.

14 Claims, 5 Drawing Sheets

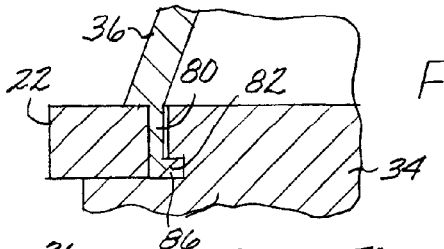
FIG. 8
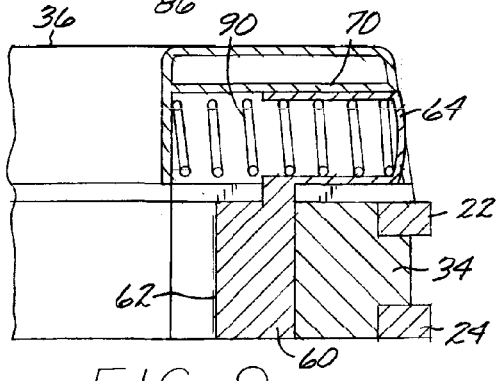
FIG. 9
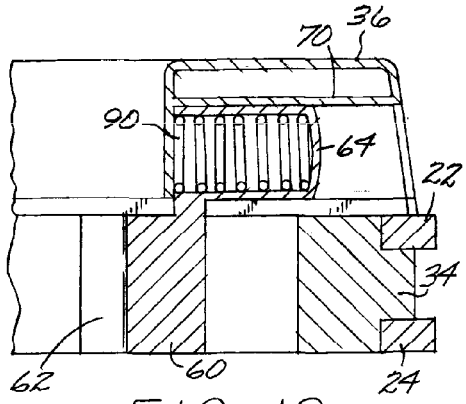
FIG. 10
FIG. 11
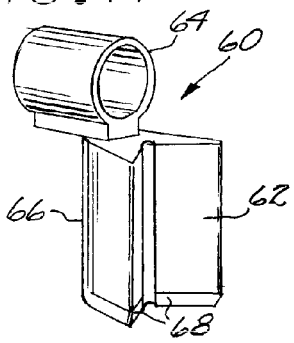
FIG. 12
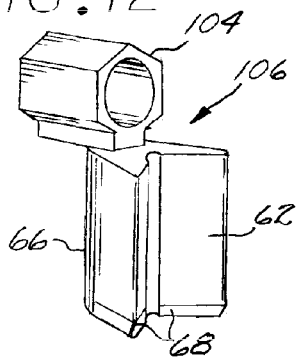
FIG. 13
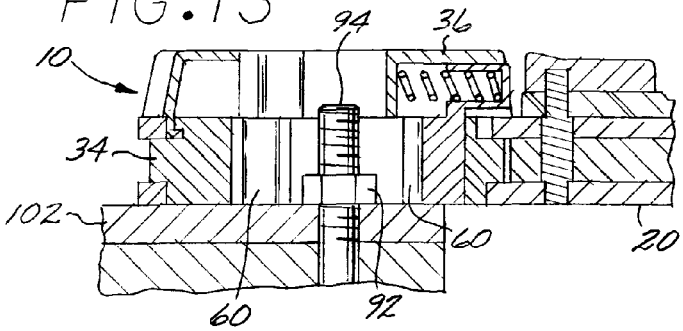

QUICK ADJUST RATCHETING WRENCH WITH CAM ACTUATED CLAMPING

FIELD OF THE INVENTION

The present invention relates to the field of hand wrench tools. More particularly, this invention is directed to a wrench tool with jaws adjusted by a cam mechanism, and a ratchet mechanism for providing a free return stroke of the handle.

BACKGROUND OF THE INVENTION

Various types of wrenches having adjustable jaws to grip a range of sizes or diameters of bolts, nuts or other fasteners have been provided with varying degrees of acceptance. Examples of adjustable jaw wrenches include open jaw types wherein the fastener is typically approached from a side and the jaws are then manually adjusted for size to fit a work piece. Ratchet action adjustable jaw wrenches typically approach the fastener from the top and then the jaws are adjusted for size to snuggly fit the fastener. The mechanisms vary in the prior art for tightening the jaws up against a work piece fastener. Adjustable jaw ratchet action wrenches typically have an annularly mounted mechanism wherein a rotatable element adjusts the jaws inwardly or outwardly to match the size of the work piece fastener. One such prior art wrench taught by Fossella (U.S. Pat. No. 5,207,127) is typical of adjustable jaw ratchet action wrenches wherein jaw elements are opposingly and slidably mounted in radial guide slots in an annularly shaped control disc coaxially positioned in the housing of the wrench. The mounted jaws elements are thrust inwardly towards the central axis of the housing by rotating an adjacent adjustment disc wherein a cam follower portion on each jaw element interacts and travels through a concentrically positioned and arch-shaped cam groove in the adjustment disc. The cam grooves have one end closer to the axis of the wrench such that when the adjustment disc is rotated in one direction the jaws elements move towards the central axis whitest turning the adjustment disc in the opposing direction moves the jaw elements away from the axis. The jaw elements have a grasping feature extending perpendicularly to the adjustment and control discs such that a centrally presented work piece is captured by opposing jaw elements by the rotation of the adjustment disc. Prior art wrenches, as this one, utilize a set of ratchet teeth on the periphery of the control disc to engage a ratchet pawl on the wrench handle thereby causing the control disc to rotate with the housing and handle. It will be appreciated that as the wrench handle is rotated, force is transferred by the ratchet pawl to the control disc, then through the cam followers held in position by the adjustment disc on the jaw elements to the gripping features of the jaw elements and finally to the work piece.

These typical prior art wrench structures present a number of disadvantages. Firstly, opening the jaws is accomplished by rotating the adjustment disc in one direction and closing the jaws requires a rotation motion in the reverse direction. In other words, the grasping is unidirectional. Further, the structure necessitates the application of similar torque levels transferred to the adjustment disc in both rotation directions for the corresponding cam surfaces to push the jaw elements in the corresponding direction thereby making certain application of the tool ineffective. Additionally, because the jaw elements are disposed perpendicularly from the control and adjustment discs, the transference of force through to the grip surface creates a cantilevering of the jaw elements generating additional frictional forces impeding operation, increasing wear of the wrench components and reduces the durability of the tool. The cantilevering further eventually widens the cam grooves which consequently affects the matching of the grip surfaces of the jaw elements with the work piece yet further impeding the operation by increasing the opportunities for the tool to bind. Of particular noteworthiness is the load transfer through the control disc wherein application of torque to the handle causes a high level of cantilever load on both the control and adjustment discs therefore necessitating hard or harden materials for their construction thereby increasing weight and manufacturing costs over lighter materials. Finally, a separate ratcheting means is often included between the control and adjustment discs to prevent their relative rotation so as to retain the jaw elements in position during the free return stroke of the wrench handle thereby necessitating significant complications to the tool design.

SUMMARY OF THE INVENTION

Accordingly, it is an object of the present invention to provide a new type of wrench having features to simplify the structure and construction, advance its convenience of use, durability and effectiveness and reduce its manufacturing cost and weight.

The structure and essence of the present invention is an adjustable wrench comprising a handle secured to a housing, an annular control disc concentrically mounted in the housing and rotatable around the axis, having a set of ratchet teeth on the periphery of the control disc and cam features on the inner edge of the control disc, a pawl in the handle disposed to selectively engage the teeth of the control disk and cause the control disc to rotate with the housing and the handle, a removable annular adjusting disc concentrically mounted in the housing next to the control disc and rotatable around the axis having a plurality of radial positioned guide slots, and a plurality of jaws in the housing, each having a slider positioned in said guide slots of the annular adjusting disc on the longitudinal axis with one degree of freedom, a cam follower interacting with the cam features of the control disc and V-shaped grip surfaces for securing a work piece.

The cam features are designed in the form of cam surfaces on the inner edge of the control disc each of which has two mirror image arch-shaped working cam profiles relative to the radius dividing its profile and having inner and outer ends relative to the vertical axis of the housing; radial guide slots are designed on the surface of the adjusting disc facing the control disc wherein each slot is limited by the inner arch-shaped edge of the adjusting disc and is open on its periphery; each jaw is designed in the form of a V-shaped grip surface with a height not exceeding the width of the control disc and an arch-shaped cam follower interacting with it on the opposite side; the slider in each blind slot is spring-loaded in a direction opposite to the working direction of the jaw; the arch-shaped profiles of cam followers and arch-shaped working cam profiles of cam features are designed at a cam pressure angle providing wedging to the rotation of the discs relative to each other during the free return stroke of the handle. Manual rotation of the adjusting disc thereby presents a different portion of the cam feature of the control disc to the cam followers of the jaws thus providing selectable adjustment of the jaws relative to a work piece.

It will be appreciated that the present invention provides for cam surfaces satisfies an object of the invention in that the cantilever torque present in prior art designs is significantly reduced permitting light weight material construction, reduced wear and improved durability and reliability. The present invention transfers torque directly from the control disc to the cam followers of the jaws. Because the cam follower is positioned in direct line with the V-shaped grip surface of the jaw there is no cantilevered torque applied to the element. The work piece is thusly in a direct line relative to the handle, pawl, control disc and jaws further improving control and efficient transfer of load to the work piece as there is no vertical force vector as present in the prior art. Another object of the invention further reducing manufacturing cost is the absence of a ratcheting mechanism fixing the control and adjusting discs during a return stroke. Yet further, there is a significant load reduction on the adjusting disc. It will be further appreciated that many other additional benefits are provided by the invention.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

FIG. 8 is an enlarged view of the present invention of FIG. 2 taken on Line 8-8 of FIG. 7 illustrating the rotatable attachment of the adjusting disc to the housing and the retention of the adjusting disc by the control disc.

FIG. 9 is a cross section view taken on Line 9-9 of FIG. 7 showing the cam follower in contact with the cam features of the control disc, the spring and guide in the guide slot of the adjusting disc with the jaws open.

FIG. 10 being similar to the view of FIG. 9 showing the cam follower thrust towards the central axis of the housing as if to grasp a work piece with the guide now compressing the spring.

FIG. 11 is a perspective view of the jaw with V-shaped grip surface, guide and cam follower of the present invention.

FIG. 12 is a perspective view of an alternate embodiment of the jaw.

FIG. 13 is the same view as FIG. 3 with the handle broken away and sitting on a work piece over a nut on a bolt illustrating no vertical torque component.

DETAILED DESCRIPTION OF THE PREFERRED EMBODIMENT

Figure 1:
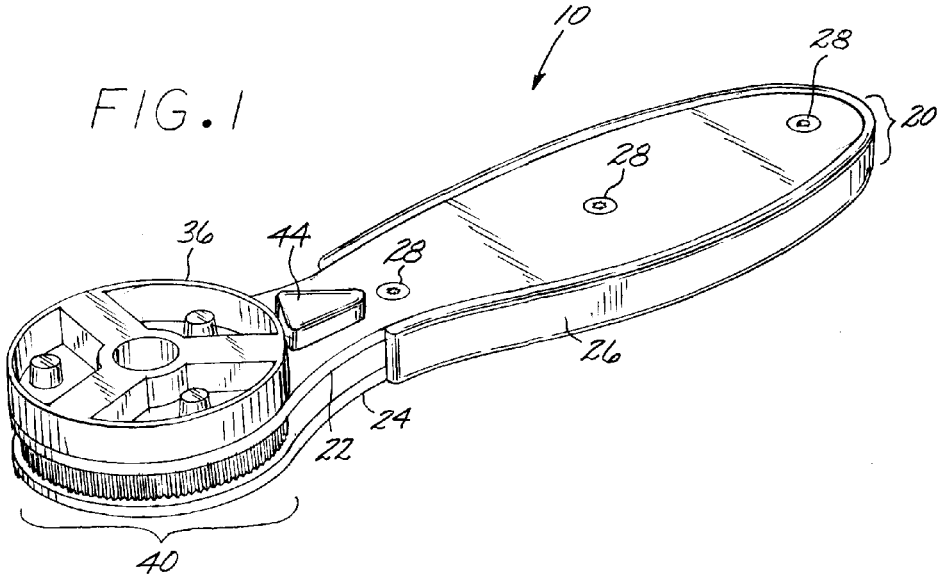
FIG. 1 is perspective view of an embodiment of the wrench according to the present invention showing a simplified alternate adjusting disc design in the housing and without pliable elastomeric layer grips so as to clearly illustrate the internal construction of the invention.

Although particular embodiments of the invention have been described in detail for purposes of illustration, various modifications may be made without departing from the spirit and scope of the invention. Accordingly, the invention is not to be limited except as by the appended claims. Referring now in greater detail to the various figures of the drawings wherein like reference characters refer to like parts, there is shown in a perspective view at 10 in FIG. 1, a new type of quick adjust ratcheting wrench with cam actuated clamping.

Figure 2:
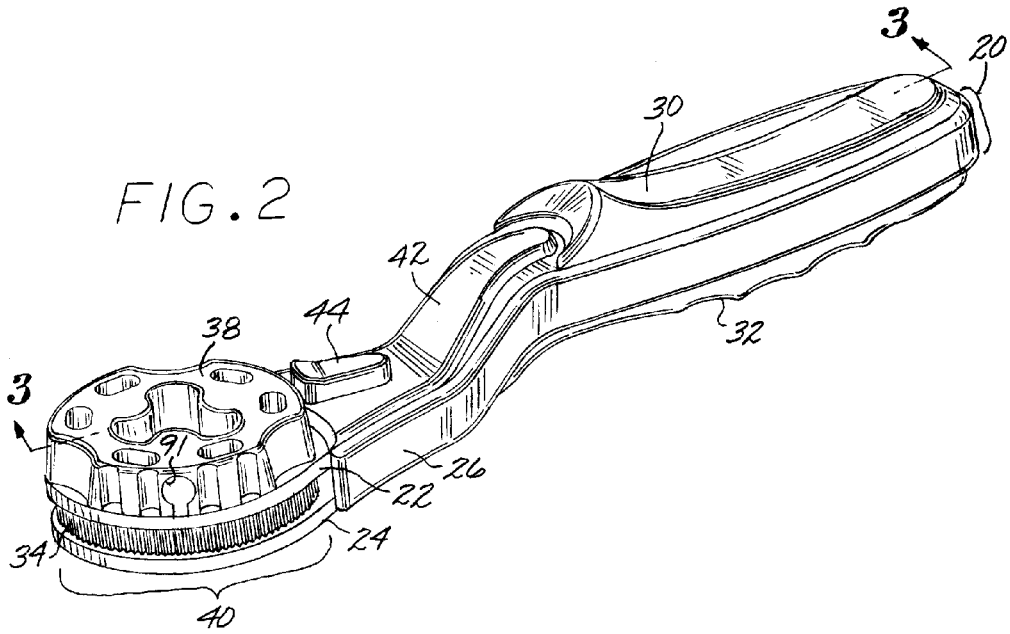
FIG. 2 is a perspective view of the preferred embodiment of the wrench according to the present invention with the preferred adjusting disc and elastomeric grip layers.

For clarity, FIG. 1 illustrates a perspective view of the essential adjustable wrench 10 according to the present invention comprising a handle 20 having top and bottom frame elements, respectively at 22 and 24, being preferably constructed of stamped sheet metal each having an annular periphery opening at one end forming the handle housing 40 and being disposed parallel to each other by means of handle insert 26 to which they are fastened with securing fasteners shown at 28. FIG. 2 illustrates the preferred embodiment wherein the top and bottom frame elements 22 and 24 are bent at the same angles and a first 30 and second 42 top, and bottom 32 elastomeric grip layers are respectively fastened to the top and bottom frame elements 22 and 24 to provide convenience and comfort of use. Similarly, in FIG. 2, the dimensions of handle insert 26 are adjusted to accommodate the bend angles of the top and bottom frame elements 22 and 24. The bend angle provides clearance for fingers and convenience for griping.

Further in FIG. 2, an annular control disc 34 is concentrically mounted in the handle housing 40, rotatable in the annular periphery opening and around the vertical axis of the handle housing 40 and has ratchet teeth on its periphery. An adjusting disc 38 is disposed on the top of the top frame element 22 of the housing 40 and is also rotatable in the annular periphery opening and around the vertical axis of the handle housing 40. A ratchet pawl selection lever 44 is shown pivotably fastened through the top frame element and attached to the ratchet pawl below. FIG. 1 shows an alternate embodiment of the adjusting disc at 36.

Figure 3:
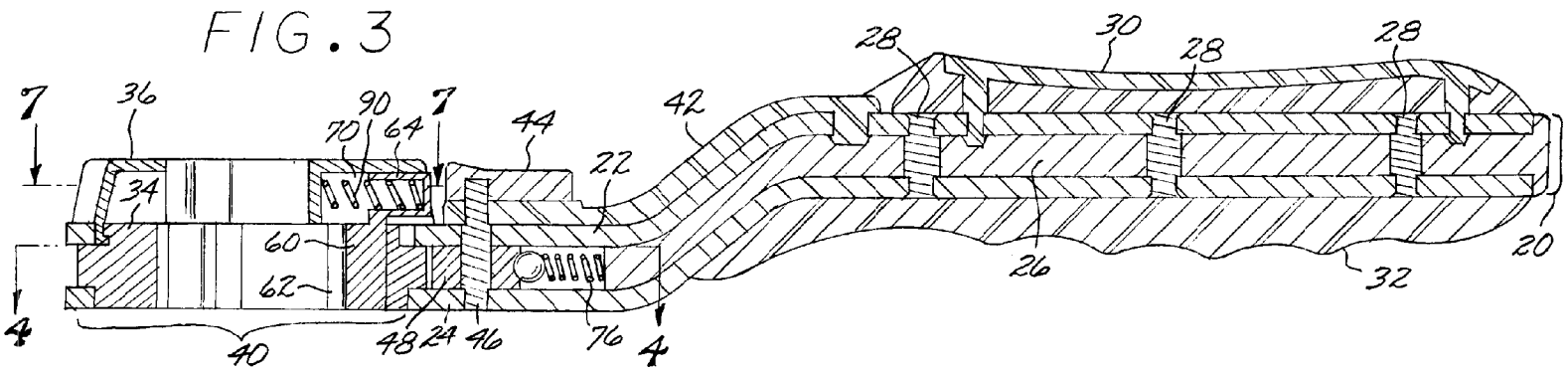
FIG. 3 is a cross section view of the present invention of FIG. 2 taken on Line 3-3 of FIG. 2.

Referring now, in further detail, to FIG. 3, a cross section view taken along Line 3-3 of FIG. 2, the arrangement of the handle portion shows the handle insert 26 spacing the top 22 and bottom 24 frame elements by means of fasteners 28. An elastomeric grip layer 32 optionally provides finger grip formations to compliment the optional palm grip formations of a first top elastomeric grip layer 30. Similarly, an optional second top elastomeric grip layer 42 provides thumb support. The annular control disc 34 is rotatably captured in the annular periphery openings of the housing 40 between top 22 and bottom 24 frame elements. The adjusting disc 36 is rotatable relative to the housing 40 and the control disc 34. FIG. 3 also shows one of a plurality of jaws 60 each comprising a V-shaped grip surface 62 facing the vertical axis of the housing 40, a cam surface 66 and guide 64 in position and spring loaded within a guide slot 70 of the adjusting disc 36. Ratchet pawl lever 44 is fixed to pawl pin 46 retained by the top 24 and bottom 26 frame elements. The pawl pin 46 is keyed into pawl 48 positioned between the top 24 and bottom 26 frame elements and so disposed as to engage the peripheral ratchet teeth of the control disc 34. The ratchet pawl lever 44 thereby may selectively pivot the pawl back and forth so as to reverse the ratchetable rotation direction of the control disc 34.

Figure 4:
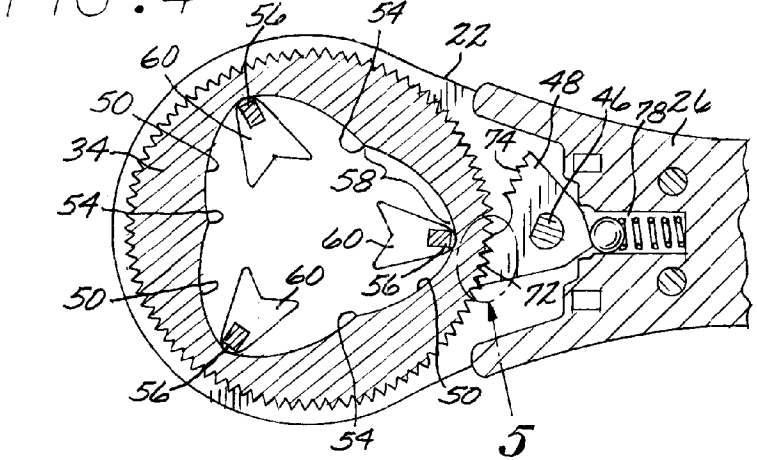
FIG. 4 is a cross section view of the present invention of FIG. 2 taken on Line 4-4 of FIG. 3 showing the cam features on the inner edge of the control disc in contact with the cam followers and the ratchet pawl engaging the teeth of the control disc.

More clearly viewed in FIG. 4, a cross section view taken on Line 4-4 of FIG. 3, the annular control disc 34 is concentrically mounted in the housing 40 with the ratchet teeth along the periphery engaging the ratchet pawl 48, pivotally mounted between the top 22 and bottom frame elements by pawl pin 46. The control disc 34 further comprises a plurality of disc cam surfaces 50 designed into the inner edge of the control disc 34. In this particular embodiment there are three disc cam surfaces; however, one skilled in the art could determine more or fewer such features be employed without circumventing the scope or spirit of the invention. In the preferred embodiment, each disc cam surface 50 is comprised of two mirror image arch-shaped working cam profiles, exemplified at 58, being disposed and positioned relative to the radius of the control disc 34 dividing each disc cam surface and having inner 54 and outer 56 ends relative to the vertical axis of the housing. Each disc cam surface, therefore, as delineated by the cam feature between successive inner points 54, comprises the two mirror image arch-shaped working cam profiles beginning at an inner point 54 and ending at the outer point 56 where the two mirror image working cam profiles meet. The working cam profiles 58 of the control disc 34 interacting with the jaw cam follower 66 of the jaw 60, as referenced in FIG. 11 showing a jaw 60. There are typically the same number of jaws 60 as disc cam surfaces 50, although it is not necessary for this to be true for all embodiments. It will be appreciated that application of torque to the handle 20 of the tool transfers torque through the pawl 48 to the control disc 34, then to the cam followers 66 of jaws 60 from the working cam profiles 58 of the control disc 34 and to the work piece from the V-shaped grip surfaces 62 of the jaws 60.

Referring briefly to FIG. 11 showing a jaw in greater detail, each jaw 60 comprises a V-shaped grip surface 62 on the facing of the center of the housing and an arch-shaped cam follower 66 positioned so as to interact with the control disc cam surfaces 50, and subsequently with the cam working profiles 58. The jaw 60 further comprises a slider 64, fixed perpendicular to the jaw V-shaped grip surface 62, bored out and blind ended at the distal end away from the jaw V-shaped grip surface 62. The slider is designed to house a slider spring for maintaining spring-loaded contact of the jaw cam followers with the control disc cam surfaces and as such protruding from the slider bore towards the axis of the housing and being opposed by features of the adjusting disc 36. The height of a jaw V-shaped surface 62 does not exceed the width of the control disc 34. Note that chamfers or facets 68 are designed into the bottom of each jaw V-shaped surface 62 so as to facilitate ease of placement of the wrench on to a fastener.

Figure 7:
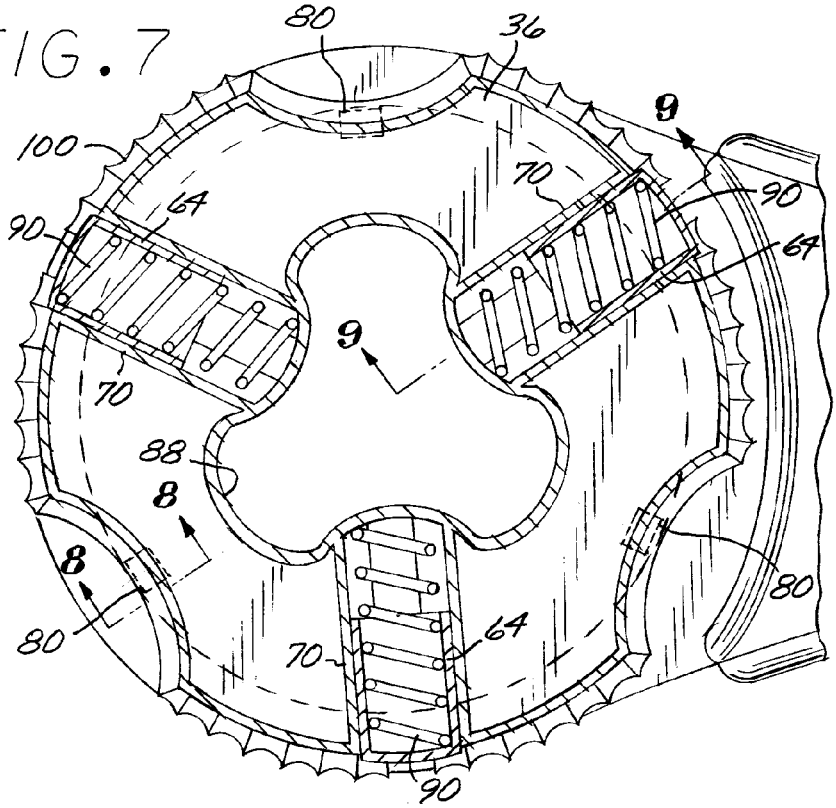
FIG. 7 is a cross section view taken on Line 7-7 of FIG. 3 showing the jaw slide element spring loaded in the radially arranged guides of the adjusting disc.

The interaction of the jaw cam followers and the control disc cam surfaces provide a mechanism for the jaws to be adjusted to fit a particular work piece size. Consequently, the relative adjustable positioning of the jaws to the control disc is an essential feature of the wrench. As such, the wrench also comprises an annular adjusting disc 36 concentrically mounted in the housing 40 positioned adjacent to the control disc 34 and rotatable around the vertical axis of the housing and moveably and rotatably jointed to the control disc 34 as shown in FIG. 7 being a section view taken along Line 7-7 of FIG. 3. For the purpose of the moveable jointing of the discs, snapping elements, shown in section at 80, are designed into the bottom surface near the outer circumference of the adjusting disc 36 and facing the control disc 34 and having inwardly facing expansions 82 extending from bottom of the snapping elements to seat in a circular groove 86 in the periphery of the control disc 34. The snapping elements are operable by tabs 91 as illustrated in FIG. 2. The snapping element feature is not intended to be limiting and one skilled in the art will realize alternate ways of moveably and rotatably jointing the annular adjusting disc 36 to either the control disc 34 or the housing, such as by means of a locking ring, that would not circumvent the scope or spirit of the present invention. An opening 88 is made in the center of the adjusting disc 36 which serves to enlarge the scope of visibility when using the wrench and, in certain cases, also advances convenience of use. Thus when being loosened, a bolt protruding far beyond a nut can pass through the central opening 88 in the adjusting disc 19 without impeding the function of the wrench as illustrated in FIG. 13.

Referring to FIG. 7, radial guide slots 70 are designed into the bottom surface of the adjusting disc 36 being the surface facing the control disc 34. In the preferred embodiment three guide slots that are oriented at 120° relative to one another and matching the number and orientation of jaws and corresponding control disc cam surfaces. Each adjusting disc radial guide slot 70 is formed by a crevice designed to match and retain a jaw slider 64 and is limited at the inner end by the features of the inner arch-shaped edge of the adjusting disc 36 forming a blind end and being open at the other end along the periphery of the adjusting disc 36. In this particular embodiment each jaw slider 64 is a bored out tubular element with a blind bottom positioned in a radial guide slot 70 on the longitudinal axis of the adjusting disc 36 and having one degree of freedom within the radial guide slot 70. One skilled in the art could easily see that the guide slots and the jaw sliders 64 can be engineered with a different structure, such as trapezoidal cross sections, or hexagonal cross sections as shown as part of an alternate embodiment jaw 106 in FIG. 12 at 104, without circumventing the scope or spirit of this invention. The jaw slider 64 is positioned in each blind slot is spring-loaded in a direction opposite to the working direction of the jaw 60. The jaw slider is therefore slidable within the adjusting disc guide slot 70. Thusly, when a jaw 60 is in position with the jaw slider 64 in an adjusting disc guide slot 70, a compression spring 90 is positioned between the blind bottom of a jaw slider 64 and the blind end of the guide slot. Referring to FIG. 9, being a cross section view taken on Line 9-9 of FIG. 7, the jaw slider 62 is in position within the adjusting disc guide slot 70 with the jaw cam follower 66 pressing, by forces of the compression spring 90, against the cam surface of the control disc 34. The jaws are in the open position in FIG. 9 whereas in FIG. 10 where the adjusting disc has been rotated relative to the control disc, the jaws are in the fully closed position as the jaw cam followers are positioned on a restricting area of the working cam profiles of the control disc. In FIG. 10, the compression spring 90 is now fully compressed. In the preferred embodiment, the adjusting disc 36 may have knurled and/or scalloped elements 100 on its periphery for the user to turn the adjusting disc 36 and adjust the jaws 60 easily. An embodiment without knurling of the adjusting disc 36 is illustrated in FIG. 1 wherein the guide slots are clearly visible.

Figure 6:
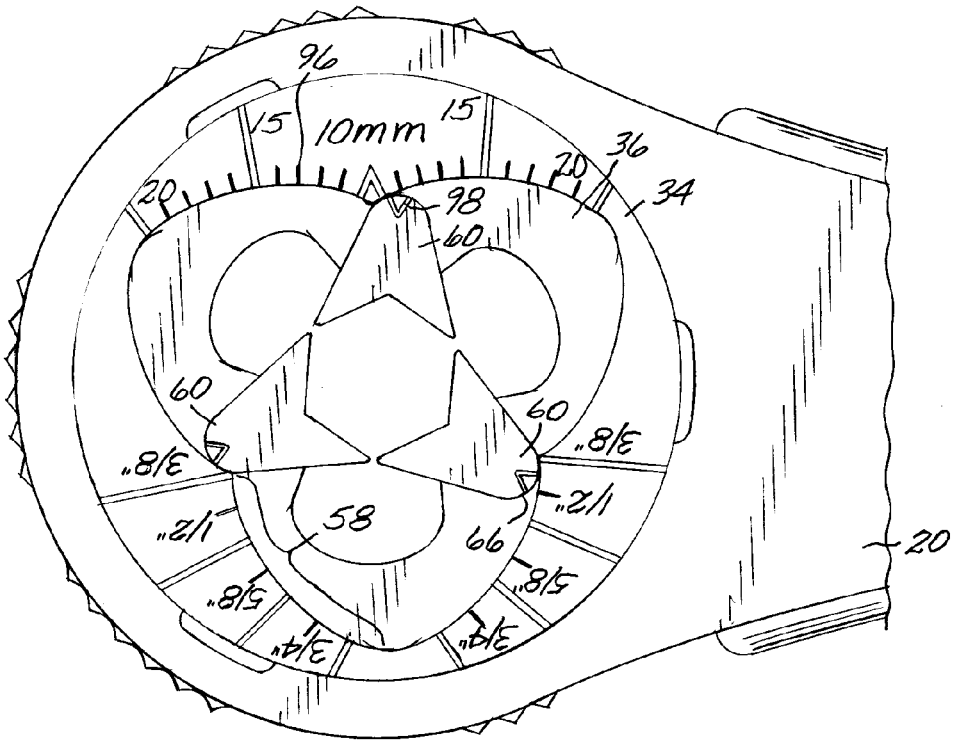
FIG. 6 is a bottom elevation view according to the present invention showing how the cam followers are selectably set for various sizes as indicated by the markings and displaying a work piece nut or bolt head size.

In FIG. 6 it will be appreciated that a distinguishing aspect of the invention is that the arch-shaped jaw cam followers 66 and the arch-shaped control disc working cam profile 58 have the cam features designed at a cam pressure angle providing wedging to the rotation of the control and adjusting discs relative to each other during torque transmission from the jaws to the control disc 34. The cam pressure angle is designed such that the torque component transmitted from the work piece fastener to the jaw cam followers 66, and subsequently to the working cam profiles 58, by the rotation of the adjusting and control discs 34 and 36 relative to each other, is less than the frictional force generated at any point of interaction between a jaw cam follower 66 and a working cam profile 58 when providing a free return stroke of the handle 20. In the preferred embodiment of three-jawed wrench, the cam pressure angle ranges from 15-25 degrees. The surface of the control disc 34 can also have gradations 96 that can be aligned with hash marks 98 any of the three jaws for proper initial adjustment of the jaws' opening. This initial adjustment is not necessary but may provide more convenience in some circumstances.

Figure 5:
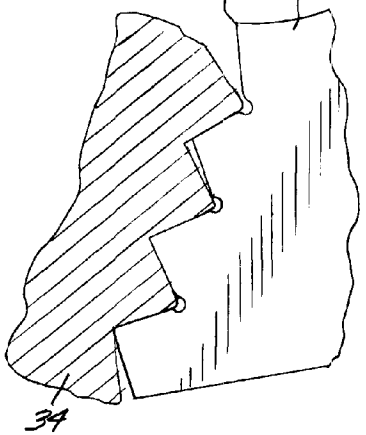
FIG. 5 is an enlarged view according to the present invention taken from FIG. 4 of the encircled area indicated by the Number 5, showing the ratchet pawl engaged with the teeth of the control disc.

Returning to FIG. 4, the details and nature of the ratcheting mechanism are shown wherein the set of ratchet teeth 9 on the control disc 34 form part of ratcheting mechanism for keying the control disc to the handle. The ratcheting mechanism includes the pawl 48 positioned between the top 22 and bottom frame elements, and specifically limited by the handle insert 26, the frame elements and the peripheral ratchet teeth on the control disc. The pawl 48 has two groups of teeth 72 and 74 that selectively engage the set of peripheral ratchet teeth on the control disc 34, and the ratchet pawl lever 44 to reposition the pawl 48. In both positions when either group of teeth 72 or 74 engages the set of peripheral ratchet teeth on the control disc 34, the pawl 48 is held by means of a spring detent 76 positioned in the opening 78 in the handle insert 26. Pivoting the pawl 48 in one direction around the pawl pin 46 allows the wrench handle to apply torque to the control disc 34 while pivoting the pawl 48 in the opposite direction to slip past said disc under braking force from the centering spring detent 76. In FIG. 5, taken from the area Number 5 of FIG. 4, the a section of the control disc 34 is illustrated with the peripheral ratchet teeth engaging one group of teeth 72 of the pawl 48. The teeth on both the pawl and control disc are designed so as to compliment each other to provide the ratcheting motion. Many ratcheting mechanisms will work for the purpose of the invention, and the particular embodiment shown is in no way intended to limit the scope of the invention.

The nature of the construction materials for each of the elements of the tool correspond to the load and wear requirements for each element. Note that the wrench has points of interaction between a work piece and the jaw V-shaped grip surfaces, the jaw cam follower and control disc cam surfaces, and the control disc ratchet teeth and the pawl implemented on the same level and plane, the majority of the load flows through these elements. In the preferred embodiment the annular adjusting disc 36 is preferably engineered from plastic such as polypropylene, ABS, glass filled nylon, or any plastic material having similar properties, reflecting the light load and wear experienced by this part, a unique feature of the present invention. A metal material and associated metal processes, such as zinc die cast, for example, may alternatively be used, although the use of a metal may increase the weight of the tool. The jaws 60, being exposed to higher loads, can be manufactured by metal injection molding (MIM), investment casting, or other suitable processes. The control disc 34 may be manufactured by powder metallurgy, forging, investment casting or many other suitable processes, and option with secondary machining. Note that the load transfer through the wrench flows across the control disc 34 and as such requires construction of a material suitable for the load.

Figure 14:
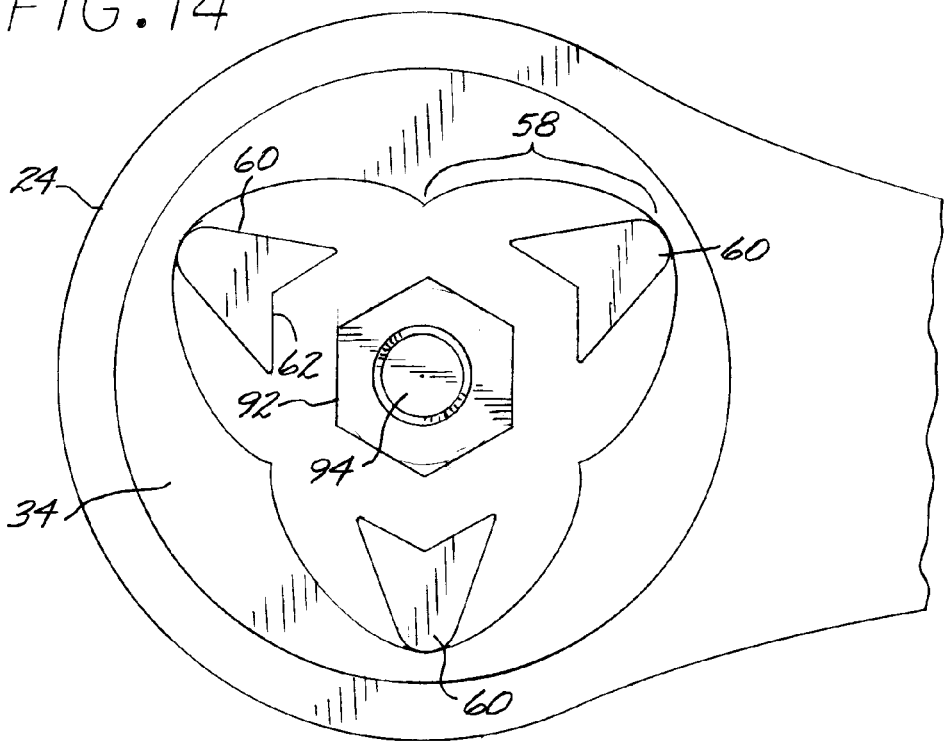
FIG. 14 is a sketch drawing showing the cam feature surfaces of the control disc, the cam followers and a nut.

The method of operation of the wrench according to the present invention is dependent upon the direction of torque required being selectable by operation of the pawl lever 44 pivoting either clockwise for clockwise torque application or counterclockwise (CC) for counterclockwise torque application. For example, for tightening a right hand bolt, clockwise torque application will tighten a bolt while the CC torque will loosen it and conversely for a left hand bolt. The steps for tightening a right hand bolt include placing the central opening of the annular adjusting disc 36 over the fastener 92 being within the size range for the particular wrench as shown in FIG. 13. Note that the wrench housing may be positioned flush with the work surface 102. As the central opening of the annular adjusting disc 36 permits a bolt 94 extending beyond the top of the nut 92 to pass through the wrench housing without impeding function of the tool. As in FIG. 14, with the wrench positioned over the nut and with one operator hand holding the outer circumference of the annular adjusting disc 36, the operator rotates the handle 20 relative to the annular adjusting disc 36 such that the annular adjusting disc 36 turns CC relative to the handle, in other words the handle turns clockwise relative to the annular adjusting disc 36. Alternatively while holding the handle position steady, the annular adjusting disc may be rotated.

Figure 15:
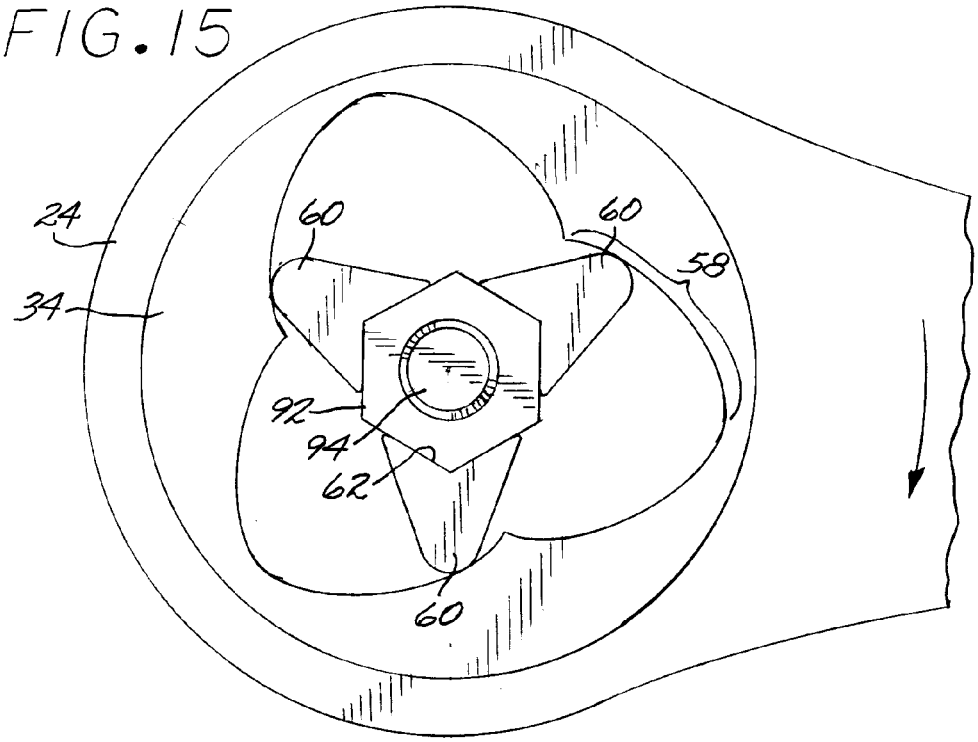
FIG. 15 is a similar view as FIG. 14 showing the cam feature surfaces of the control disc rotated to move the cam followers such that the V-shaped grip faces of the jaws engage the work piece.

Note that with the proper initial setting of the pawl lever 44, the control disc 34 will also turn sympathetically with the handle 20. Now referring to FIG. 15, when the control disc 34 turns relative to the annular adjusting disc 36, corresponding working cam profiles 58 of the cam surfaces 50 of the control disc 34 will push the corresponding jaw cam followers 66 of the corresponding jaws 60 radially inwards until the jaw V-shaped grip surfaces 62 clamp on the fastener hex. Slight adjustments in the angular orientation of the annular adjusting disc 36 may be needed so that the jaw V-shaped grip surfaces 62 align properly with the fastener hex sides; however, the jaws will tend to self adjust and align themselves once the jaws initiate contact with the fastener. With the jaw V-shaped grip surfaces 62 aligned and completely intimate with the fastener hex, torque can be applied to the fastener. As the fastener resists the torque, the working cam profiles 58 forces the jaw V-shaped grip surfaces 62 towards the fastener in proportion to the torque applied and the cam angle engineered into the profile. During a free return stroke of the handle 20, in a CC direction, as in this particular case, the torque component transmitted from the fastener to the cam followers 66 of the jaws 60, and subsequently to the working cam profiles 58 of the control disc 34, and rotation the both discs 34 and 36 relative to each other, is less than the friction force generated at any point of interaction between a jaw cam follower 66 and a control disc working cam profile 58, thereby holding the jaws 60 immoveable. Thus, unlike the prior art, the present invention does not need a complementary ratcheting means providing wedging to the discs and is therefore simpler in structure and construction.

Thus the preferred embodiment has the following advantages including bringing the jaws close to the sides of the fastener such that the user can rotate the adjusting disc either clockwise for clockwise torque application or counter clockwise for counterclockwise torque application. Moreover, the application of a relatively small amount of torque is enough to move the jaws from the fastener since the jaw sliders are spring loaded in a direction opposite to the working direction of the jaws, thereby the present invention provides a higher degree of convenience to the user. A further benefit is accomplished by the height of each cam profile of a jaw not exceeding the width of the control disc thusly preventing generation of additional frictional forces. Thus the operation of the tool is simplified and its durability advanced. Furthermore, because the invention has no cam slots, spring-loaded sliders provide the matching of the jaw V-shaped grip surfaces with the sides of the fastener even when cam working profiles eventually wear, thereby improving operation of the tool and advancing its durability and effectiveness. Also, it will be noted that application of torque to the handle of the preferred embodiment causes only a small amount of cantilever load on the adjusting disc; thusly permitting some wrench elements to be manufactured from plastic which reduces the weight and manufacturing cost of the tool.

While preferred embodiments of this invention have been illustrated and described, variations and modifications may be apparent to those skilled in the art. Therefore, we do not wish to be limited thereto and ask that the scope and breadth of this invention be determined from the claims which follow rather than the above description.

What is claimed is:

1. An adjustable ratchet wrench with cam actuated clamping comprising a handle secured to a housing, the housing having an axis, an annular control disc concentrically mounted in the housing and rotatable around the housing axis, having a set of ratchet teeth on the periphery of the control disc and a plurality of cam features in the plane of the control disc and on the inner edge of the control disc each cam feature having a symmetrical arch like form being comprised of two mirror image arch-shaped working profiles meeting at the top of the arch with the top of each cam feature being disposed towards the periphery of the control disc and centered on the housing axis radius, a pawl in the handle disposed to selectively engage the teeth of the control disk and cause the control disc to rotate in the corresponding rotational direction with the housing and the handle, a removable annular adjusting disc concentrically mounted in the housing next to the control disc having a width and rotatable around the housing axis having a plurality of radial positioned guide slots, each having a length and longitudinal axis, each being disposed so as to permit alignment with each cam feature of the control disc, on the radius of the housing and perpendicular to the housing axis, wherein the guide slots are designed on the surface of the adjusting disc surface facing the control disc, each guide slot being limited by features of the adjusting disc at the guide slot end nearest the housing axis and being open at the opposing guide slot end at the periphery of the adjusting disc, and a plurality of jaws disposed in the housing, each having a slider positioned in said guide slots of the annular adjusting disc on the longitudinal axis with one degree of freedom so as to be free to slide radially on the housing radius, and perpendicular to the housing axis along the length of each slot, an arch shaped cam follower facing outwardly from the housing axis and disposed to interact with and be in contact with the cam features of the control disc, a compression spring disposed in each guide slot between the limiting feature of the slot and the jaw element slider providing a force to maintain the jaw cam follower in contact with a working profile of the control disc cam features, and a V-shaped grip surface positioned parallel to the housing axis for securing a work piece, whereby a user selectable rotation of the adjusting disc relative to the control disc determines the contact location between the disc cam feature and the jaw cam follower so as to position the jaw V-shaped grip surfaces relative to the housing axis and independently of torque applied to the housing handle relative to a work piece that produces the cam actuated clamping.

2. The adjustable ratchet wrench with cam actuated clamping as in claim 1 wherein the handle is further comprising top and bottom frame elements being formed from sheet metal, each frame element having an annular periphery opening at one end forming the housing, the frame elements being disposed parallel to each other by means of a handle insert positioned between the frame elements to which they are fastened with securing fasteners.

3. The adjustable ratchet wrench with cam actuated clamping as in claim 1 further comprising a bottom elastomeric grip layer secured to the bottom frame element optionally fashioned to provide finger grip formations to compliment, a top elastomeric grip layer secured to the top frame element optionally fashioned to provide palm grip formations.

4. The adjustable ratchet wrench with cam actuated clamping as in claim 1, wherein the jaw V-shaped grip surface has a height not exceeding the width of the control disc.

5. The adjustable ratchet wrench with cam actuated clamping as in claim 1, wherein the handle further comprises a bend offset to provide finger room and convenience of use.

6. The adjustable ratchet wrench with cam actuated clamping as in claim 1, wherein the wrench further has points of interaction between a work piece and the jaw V-shaped grip surfaces, the jaw cam follower and control disc cam surfaces, and the control disc ratchet teeth and the pawl implemented on the same level and plane.

7. The adjustable ratchet wrench with cam actuated clamping as in claim 1 wherein the inner edge of the control disc comprises three cam surfaces disposed at 120 degree intervals.

8. The adjustable ratchet wrench with cam actuated clamping as in claim 1, wherein the cam pressure angle providing wedging to the rotation of the discs relative to each other during free return stroke of the handle ranges from 15-25 degrees.

9. The adjustable ratchet wrench with cam actuated clamping as in claim 1, wherein the adjusting disc is manufactured from plastic.

10. The adjustable ratchet wrench with cam actuated clamping as in claim 1, wherein the adjusting disc is manufactured from metal.

11. The adjustable ratchet wrench with cam actuated clamping as in claim 1, wherein the control disc is further comprising gradation scale markings and the jaws further having marks to interact with the gradation scale markings so when aligned together provide and indication for proper initial adjustment of the jaw opening before placing the tool over the fastener.

12. The adjustable ratchet wrench with cam actuated clamping as in claim 1, wherein the jaw is further comprising chamfers designed at the bottom of each jaw V-shaped surface to facilitate placement over a work piece.

13. The adjustable ratchet wrench with cam actuated clamping as in claim 1, wherein an opening is made in the center of the adjusting disc through which a bolt can pass.

14. The adjustable ratchet wrench with cam actuated clamping as in claim 1, further comprising a tabbed snapping element disposed along the periphery of the adjusting disc and the control disc selectably restricting the rotation of the adjusting disc relative to the control disc.

* * * * *